United States Patent [19]

Hamman et al.

[11] Patent Number: 4,618,078

[45] Date of Patent: Oct. 21, 1986

[54] VENTED NESTABLE POURING SPOUT

[75] Inventors: Martin E. Hamman; Gary M. Baughman, both of Auburn, Ind.

[73] Assignee: Rieke Corporation, Auburn, Ind.

[21] Appl. No.: 643,070

[22] Filed: Aug. 22, 1984

Related U.S. Application Data

[63] Continuation-in-part of Ser. No. 610,688, May 16, 1984, Pat. No. 4,555,048.

[51] Int. Cl.[4] ..... B67D 3/00

[52] U.S. Cl. ..... 222/478; 222/529; 222/547; 222/564

[58] Field of Search ..... 222/529, 478, 488, 526, 222/538, 484, 530, 527, 566, 567, 569, 570, 564, 547

[56] References Cited

U.S. PATENT DOCUMENTS

| | | | |
|---|---|---|---|
| 2,471,172 | 5/1949 | Stoller | 215/11 |
| 2,561,596 | 7/1951 | Rieke | 222/527 |
| 2,565,699 | 8/1951 | Rieke | 222/529 |
| 2,661,128 | 12/1953 | Rieke | 222/529 |
| 2,804,242 | 8/1957 | Borah | 222/478 |
| 2,840,280 | 6/1958 | Bee | 222/478 |
| 2,895,654 | 7/1959 | Rieke | 222/529 |
| 3,040,938 | 7/1962 | Smith | 222/478 |
| 3,075,676 | 1/1963 | Borah | 222/527 |
| 3,091,373 | 5/1963 | Kirschenbaum | 222/547 |
| 3,093,273 | 7/1963 | Borah | 222/527 |
| 3,250,428 | 5/1966 | Rieke | 220/60 |
| 3,604,740 | 9/1971 | Summers | 292/256.61 |
| 3,613,966 | 10/1971 | Summers | 222/529 |
| 3,717,289 | 2/1973 | Laurizio | 222/481 |
| 3,717,324 | 2/1973 | Milde | 251/331 |
| 3,804,305 | 4/1974 | Rieke | 222/538 |
| 4,073,413 | 2/1978 | Tabler et al. | 222/529 |
| 4,295,583 | 10/1981 | Schurr | 222/478 |

FOREIGN PATENT DOCUMENTS

| | | | |
|---|---|---|---|
| 0648664 | 8/1937 | Fed. Rep. of Germany | 222/478 |

*Primary Examiner*—Joseph J. Rolla
*Assistant Examiner*—Louise S. Heim
*Attorney, Agent, or Firm*—Woodard, Weikart, Emhardt & Naughton

[57] ABSTRACT

A vented, nestable-extendable pouring spout for use with a container having an opening therein includes an annular mounting portion adapted to be secured to an annular lip encompassing the opening of the container. A generally funnel shaped flexible body portion is secured at its larger circumferential edge to the mounting portion and at its smaller circumferential edge to a tubular neck portion located inwardly of the mounting portion. The body portion has an invertible fold portion adjacent the mounting portion to which is attached a plurality of circumferentially spaced ears, each ear having a pair of cylindrically shaped nibs extending therefrom. In the nested orientation of the spout, the ears extend downwardly out of the way of the nested neck and body portions. As the spout is extended, causing the invertible fold portion to invert, each ear rotates inwardly about its point of attachment until the ears extend inwardly perpendicular to the longitudinal axis of the spout. In this orientation, the ears and nibs define a central flow aperture having a dentated perimeter for the outflow of liquid and a plurality of peripheral vent openings, one between each ear, for the inflow of air.

17 Claims, 5 Drawing Figures

VENTED NESTABLE POURING SPOUT

CROSS-REFERENCE TO RELATED APPLICATION

This application is a continuation-in-part of application Ser. No. 610,688, filed May 16, 1984, now U.S. Pat. No. 4,555,048.

BACKGROUND OF THE INVENTION

1. Field of the Invention

This invention relates in general to nestable and extendable pouring spouts for containers and in particular to such spouts having a venting means for reducing pulsations in the outflowing liquid.

2. Description of the Prior Art

There are a number of prior known nestable and extendable pouring spouts. Representative examples are shown in the following U.S. Pat. Nos: 2,561,596 to Rieke, July 24, 1951; 2,565,699 to Rieke, Aug. 28, 1951; 2,661,128 to Rieke, Dec. 1, 1953; 2,895,654 to Rieke, July 21, 1959; 3,040,938 to Smith, June 26, 1962; 3,250,428 to Rieke, May 10, 1966; 3,604,740 to Summers, Sept. 14, 1971; 3,613,966 to Summers, Oct. 19, 1971; 3,804,305 to Rieke, Apr. 16, 1974; and 4,295,583 to Schurr, Oct. 20, 1981.

Of the above listed patents, Nos. 3,040,938 and 4,295,583 relate particularly to vented spouts.

In many cases a smooth outflow of liquid from the spout of a container is particularly important. Examples are where it is desired to decant a precise amount of liquid from a large stock container into a smaller container or where the liquid is corrosive or toxic and splashing must therefore be avoided.

Smooth, pulsation-free overflow may be obtained with a conventional spout by carefully controlling the angle of the spout with regard to the fluid level in the container so that the spout never flows full, thereby maintaining an air passageway through the spout into the container. One disadvantage of this method is that the required degree of control is often difficult to maintain, especially where the container is heavy. Another disadvantage is that only a fraction of the cross sectional area of the spout is available for fluid outflow when the container is near full, thus increasing the time necessary to decant the liquid.

As a solution to the aforementioned problems, prior nestable and extendable spouts have been fitted with venting devices for maintaining an air passageway through the spout regardless of the angle of pouring, enabling venting of the container even though the opening of the container is completely submerged (see Smith, 3,040,938 and Schurr, 4,295,583). These prior venting devices are essentially tubes mounted concentrically within the neck of the spout so as to form an annular air space between the tube and the neck. The base of the tube is fitted with a flange having a plurality of small peripheral channels, which flange is drawn up against the base of the spout when the spout is in its extended orientation. In this orientation, air may enter the container through the annular space and the peripheral channels while the fluid exits through the central tube.

Although the venting devices exemplified in Smith ('938) and Schurr ('583) function well, they have non-functional disadvantages associated with their structure. For instance, the venting device must be manufactured as a separate piece which is then mounted within the neck of the spout and secured thereto by welding or adhesive. This is a relatively expensive manufacturing process. Additionally, the venting device adds to the overall axial length of the spout when it is in its nested orientation, thus increasing the handling, packaging and shipping costs of such a spout.

It would be desirable to provide a nestable and extendable pouring spout with a self contained venting means which may be inexpensively manufactured and which maintains the compact configuration of such spouts.

SUMMARY OF THE INVENTION

A pouring spout for use with a container, according to one embodiment of the present invention, includes a spout having means for alternately disposing the spout in a nested orientation or in an extended pouring orientation and means for securing the spout to the container. A plurality of circumferentially spaced ears are attached to the spout and extend therefrom without interference with the spout when the spout is in its nested orientation. The ears extend inwardly substantially perpendicular to the longitudinal axis of the neck portion when the spout is in its extended orientation. When in this configuration, the ears define a central restricted flow aperture for the outflow of liquid and each pair of adjacent ears defines a peripheral vent opening therebetween for the inflow of air.

One object of the present invention is to provide an improved self-venting nestable pouring spout which is compact and inexpensive to manufacture.

Related objects and advantages of the present invention will become apparent from the following description.

DESCRIPTION OF THE PREFERRED EMBODIMENT

Figure 1:
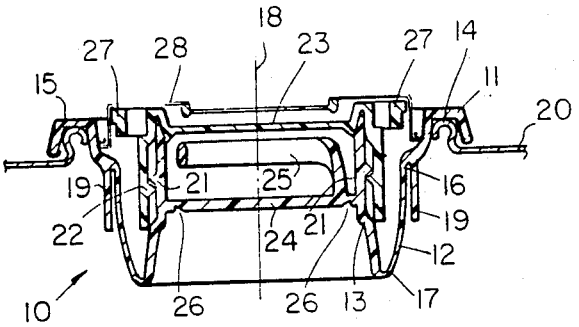
FIG. 1 is an elevation view in full section of one embodiment of the vented nestable pouring spout of the present invention, shown in its nested orientation.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
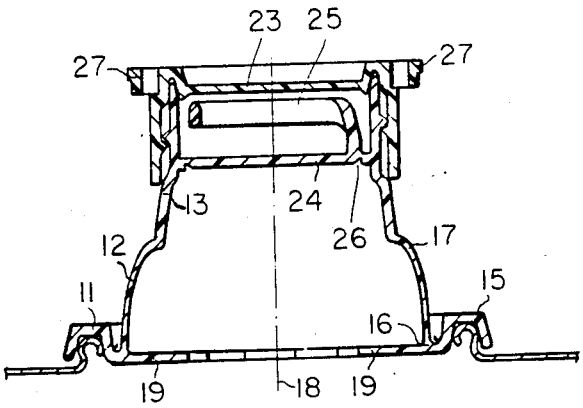
FIG. 2 is an elevation view in full section of the spout of FIG. 1, shown in its extended orientation.

Referring to FIGS. 1 and 2, there is illustrated nestable pouring spout 10 having as its principle components a mounting portion 11, a body portion 12, and a neck portion 13. In the preferred embodiment, mounting portion 11, body portion 12, and neck portion 13, together with ears 19, seal 24 and pull ring 25 which are described below, are integrally molded from a low density flexible polyethylene plastic.

Mounting portion 11 is an annular U-shaped channel configured to mount on an annular lip 14 which encompasses a generally circular opening in a container 20. Lip 14 may be made of plastic or metal. Anchor ring 15, which is preferably constructed of zinc plated steel, is crimped over mounting portion 11 to compress it about and secure it to lip 14, thereby effecting an air-tight, liquid-tight seal between mounting portion 11 and lip 14.

Body portion 12 is a generally funnel shaped member which is secured at its larger circumferential edge to mounting portion 11 and at its smaller circumferential edge to neck portion 13. Body portion 12 includes invertible fold portions 16 and 17, which folds cause body portion 12 to be generally S-shaped in section along a plane parallel to the longitudinal axis 18 of nestable pouring spout 10. Body portion 12 is substantially circular in cross-section along a plane perpendicular to axis 18. Attached at the outside surface of invertible fold portion 16 is a plurality of circumferentially spaced ears 19, each of which extends downwardly substantially parallel to longitudinal axis 18 when nestable pouring spout 10 is in its nested orientation. In this orientation the ears do not restrict the opening of the container and do not interfere with the attainment of a fully nested orientation by the neck and body portions. Ears 19 provide a self-venting action for spout 10, which will be described in greater detail below.

Neck portion 13 is a generally cylindrical tube having threads 21 near its upper end for theadedly receiving a cap 23 having corresponding threads 22. Disposed within the opening of neck portion 13 is a disk-like seal 24 having a pull ring 25 attached proximate one edge of seal 24. Seal 24 is provided with an annular peripheral groove 26 which provides a weakened point at which seal 24 will break away when pull ring 25 is pulled.

Cap 23, which is preferably molded from a high density polyethylene plastic, includes integrally molded flexible bail handles 27 which, when cap 23 is threadedly attached to neck portion 13, provide a convenient means for grasping neck portion 13 and pulling it out into its extended orientation, as is shown in FIG. 2.

When nestable pouring spout 10 is in its initial nested orientation prior to opening, there is disposed over cap 23 and neck portion 13 a tamper indicating seal 28 which, if it is intact and undeformed, provides a quick visual indication that there has been no attempt to open nestable pouring spout 10.

A nestable pouring spout which is generally of the type shown herein, but without ears 19, is more fully disclosed in U.S. Pat. No. 3,613,966 issued to Summers on Oct. 19, 1971, which disclosure is hereby incorporated by reference.

Figure 4:
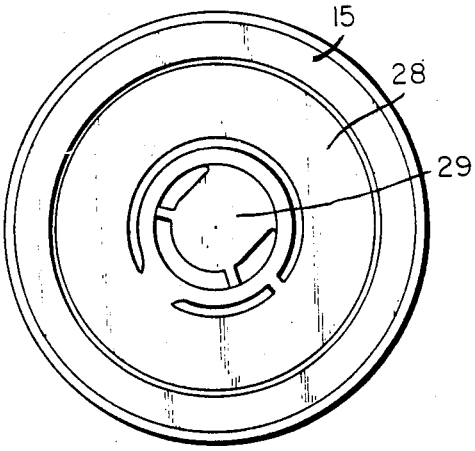
FIG. 4 is a top plan view of the spout of FIG. 1, particularly showing the tamper indicating seal.

The user of a container having a nestable pouring spout 10 mounted thereon first grasps pull-tab 29 on tamper indicating seal 28 (see FIG. 4), pulls the seal free and discards it. Bail handles 27 on cap 23 are then grasped and pulled in order to draw neck portion 13 out into its extended orientation. Cap 23 is then unscrewed and removed to gain access to seal 24. Pull ring 25 is grasped by the user and pulled, causing seal 24 to break free along groove 26. The contents of the container can then be poured out and cap 23 can be screwed back onto neck portion 13 to reseal the container in the event that the container is only partially emptied.

As neck portion 13 is drawn outwardly, invertible fold portions 16 and 17 of body portion 12 invert such that the S-shaped curvature of body portion 12 is reversed when neck portion 13 is in its fully extended orientation, as is shown in FIG. 2. In particular, as invertible fold portion 16 inverts, each ear 19, which is securely attached thereto, will rotate inwardly substantially about its point of attachment. When neck portion 13 and body portion 12 reach their fully extended orientations, ears 19 extend inwardly from mounting portion 11 substantially perpendicular to longitudinal axis 18.

Figure 3:
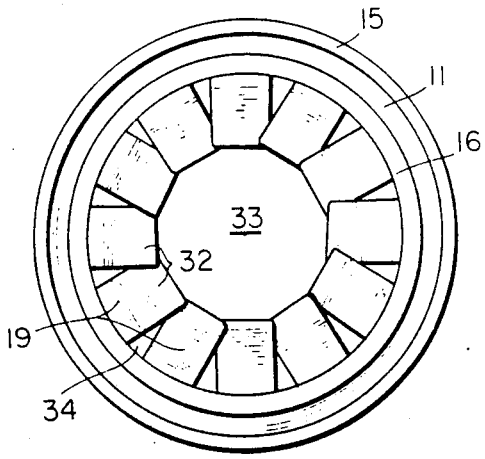
FIG. 3 is a bottom plan view of the spout of FIG. 1 in its extended orientation, particularly showing the venting structure.

As is shown most clearly in FIG. 3, in the extended orientation of spout 10, end portions 32 of adjacent ears 19 are contiguous so as to define a central flow aperture 33. In this orientation ears 19 also define a plurality of generally triangular peripheral vent openings 34, one located between each pair of adjacent ears 19.

Because flow aperture 33 is of a somewhat smaller diameter than the interior diameter of neck portion 13, the outward flow of liquid from the container does not fill neck portion 13. It should be noted that liquid will flow out of some of the submerged peripheral vent openings also, especially those at the lowest elevation for a particular pouring angle. Therefore, the area of the peripheral openings must be taken into account in determining the best relationship of the diameter of aperture 33 to the diameter of neck portion 13 to insure that neck portion 13 does not flow full at any pouring angle. This insures that air may always enter through neck portion 13, through the uppermost peripheral vent openings 34, and into the container, thereby equalizing the pressure within and without the container and permitting the smooth outflow of liquid.

The incoming air enters the container peripherally of the outflowing liquid stream so that the liquid stream is not interrupted and pulsation and splashing are kept to a minimum while permitting full flow through flow aperture 33. Although the precise dynamics of the liquid and air flow are not fully understood, it is believed that the optimum ratio between the area of the peripheral vent openings 34 and the central aperture 33 is a function of the viscosity and surface tension characteristics of the liquid.

It has been observed that when high viscosity liquids are being decanted, a portion of the incoming air will pass through central flow aperture 33. The air which enters through aperture 33 tends to form large bubbles which span the diameter of aperture 33, causing pulsations and discontinuities in the liquid outflow. This phenomenon may be partially controlled by increasing the area of each peripheral vent opening to enable a greater portion of the incoming air to pass through the peripheral vent openings rather than through the central flow aperture. One way to make each peripheral vent opening larger is to use a lesser number of ears. The area of each peripheral vent opening can also be increased by specially shaping the ears, such as by making each ear relatively narrow at its base where it is attached to the invertible fold, with each ear increasing in width toward its end portion.

Figure 5:
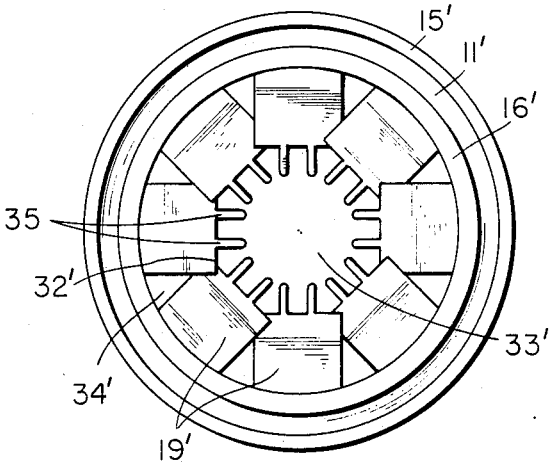
FIG. 5 is a bottom plan view of an alternate embodiment of a vented nestable pouring spout in its extended orientation, particularly showing the venting structure.

One embodiment particularly suited for viscous liquids is illustrated in FIG. 5. The members shown in FIG. 5 which correspond to similar previously described members are designated with corresponding primed numerals. For example, ears 19' in FIG. 5 correspond to similar ears 19 in FIG. 3. As shown, the embodiment of FIG. 5 includes cylindrically shaped nibs 35 which are molded integrally with and project from ears 19' inwardly into aperture 33' when the spout is in its extended pouring orientation. Nibs 35 in combination with ears 19' define a central flow aperture 33' which has a dentated perimeter in the sense that the aperture has perimetrically located toothlike projections which extend inwardly. The dentated perimeter serves to break up any large bubble which might otherwise tend to pass whole through aperture 33'. By breaking up large bubbles into smaller bubbles, the outflow of liquid is made more nearly continuous with fewer and smaller pulsations. It is to be understood that nibs 35 need not be of the particular shape shown. For example, nibs 35 could be triangularly or rectangularly shaped, and there could be more or fewer nibs per ear.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A pouring spout for use with a container, comprising:

a spout having means for alternately disposing said spout in a nested orientation or in an extended pouring orientation;

means for securing said pouring spout to said container; and a plurality of ears moveably attached with respect to said spout, said ears extending inwardly within said spout and cooperating to define a central flow aperture for the outflow of liquid and a plurality of peripheral vent openings for the inflow of air, when, and only when, said spout is disposed in the extended pouring orientation.

2. The spout of claim 1, wherein said plurality of ears are circumferentially spaced and are substantially perpendicular to the longitudinal axis of said spout.

3. A spout for use with a container having an opening therein, said spout being configured to be alternately disposed in nested and extended orientations, comprising:

an annular mounting portion;

means for securing said annular mounting portion to said container at the opening;

a neck portion located concentrically with and inwardly of said mounting portion;

a body portion disposed between said neck portion and said annular mounting portion and of integral construction therewith;

means for extending said spout from the nested orientation to the extended orientation; and a plurality of circumferentially spaced ears attached to said spout such that said ears extend downwardly without interference with said neck portion when said spout is in its nested orientation, said ears extending inwardly substantially perpendicular to the longitudinal axis of said neck portion when said spout is in its extended orientation;

said plurality of ears cooperating to define a central flow aperture for the outflow of liquid, the central flow aperture having a dentated perimeter, each pair of adjacent ears defining a peripheral vent opening therebetween for the inflow of air, when said spout is in its extended orientation.

4. The spout of claim 3, wherein the area of the central flow aperture and the area of the peripheral vent openings is such that the neck portion does not flow full, thereby maintaining an air passageway through the neck portion into the container at all pouring angles.

5. The spout of claim 3, wherein said body portion has an invertible fold portion adjacent said mounting portion, said ears being attached directly to the outer surface of said invertible fold portion.

6. The spout of claim 5, wherein said ears are substantially rectangular plates, each having a width and a length dimension such that the end portions of adjacent ears are contiguous when said spout is in its extended orientation, whereby a substantially triangular vent opening is provided between adjacent ears.

7. The spout of claim 6, wherein the dentated perimeter of the central flow aperture is defined by said ears and a plurality of nibs extending from said ears.

8. The spout of claim 7, wherein said plurality of nibs includes a pair of cylindrically shaped nibs extending from the end portion of each ear.

9. The spout of claim 6, wherein said extending means includes a removable, resealable cap having an attached bail handle.

10. The spout of claim 9, and further including a removable seal within the neck portion.

11. The spout of claim 10, and further including a tamper indicating seal attached to said spout and disposed over the cap when said spout is in its initial nested orientation.

12. An improved container spout of the type having an outer mounting portion, a smaller inner tubular neck portion, and a body portion secured to said mounting portion which extends downwardly and inwardly therefrom and is secured to said neck portion, said body portion having an invertible fold portion adjacent said mounting portion, which spout is extendable from a nested orientation to a pouring orientation and vice versa, and is secured to an opening in the container, wherein the improvement comprises:

a plurality of circumferentially spaced ears attached to said spout such that said ears extend downwardly to avoid interference with said neck portion when said spout is in its nested orientation, said ears extending inwardly substantially perpendicular to the longitudinal axis of said neck portion when said spout is in its extended orientation;

said plurality of ears cooperating to define a central flow aperture for the outflow of liquid, the central flow aperture having a dentated perimeter, each pair of adjacent ears defining a peripheral vent opening therebetween for the inflow of air, when said spout is in its extended orientation.

13. The spout of claim 12, wherein the area of the central flow aperture and the area of the peripheral vent openings are such that the neck portion does not flow full, thereby maintaining an air passageway through the neck portion into the container at all pouring angles.

14. The spout of claim 13, wherein said ears are directly attached to the outer surface of the invertible fold portion of said body portion such that said ears rotate inwardly substantially about their point of attachment as the invertible fold inverts when said spout is drawn into its extended orientation.

15. The spout of claim 14, wherein said ears are substantially rectangular plates, each having a width and a length dimension such that the end portions of adjacent ears are contiguous when said spout is in its extended orientation, whereby a substantially triangular vent opening is provided between adjacent ears.

16. The spout of claim 15, wherein the dentated perimeter of the central flow aperture is defined by said ears and a plurality of nibs extending from said ears.

17. The spout of claim 16, wherein said plurality of nibs includes a pair of cylindrically shaped nibs extending from the end portion of each ear.

* * * * *

REEXAMINATION CERTIFICATE (844th)

United States Patent [19]

Hamman et al.

[11] B1 4,618,078

[45] Certificate Issued Apr. 26, 1988

[54] VENTED NESTABLE POURING SPOUT

[75] Inventors: Martin E. Hamman; Gary M. Baughman, both of Auburn, Ind.

[73] Assignee: Rieke Corporation, Auburn, Ind.

Reexamination Request:
No. 90/001,203, Mar. 23, 1987

Reexamination Certificate for:

| | |
|---|---|
| Patent No.: | **4,618,078** |
| Issued: | **Oct. 21, 1986** |
| Appl. No.: | **643,070** |
| Filed: | **Aug. 22, 1984** |

Related U.S. Application Data

[63] Continuation-in-part of Ser. No. 610,688, May 16, 1984, Pat. No. 4,555,048.

[51] Int. Cl.[4] ..... B67D 3/00

[52] U.S. Cl. ..... 222/478; 222/529; 222/547; 222/564

[56] References Cited

FOREIGN PATENT DOCUMENTS 1924824 11/1978 Fed. Rep. of Germany .

*Primary Examiner*—Joseph J. Rolla

[57] ABSTRACT

A vented, nestable-extendable pouring spout for use with a container having an opening therein includes an annular mounting portion adapted to be secured to an annular lip encompassing the opening of the container. A generally funnel shaped flexible body portion is secured at its larger circumferential edge to the mounting portion and at its smaller circumferential edge to a tubular neck portion located inwardly of the mounting portion. The body portion has an invertible fold portion adjacent the mounting portion to which is attached a plurality of circumferentially spaced ears, each ear having a pair of cylindrically shaped nibs extending therefrom. In the nested orientation of the spout, the ears extend downwardly out of the way of the nested neck and body portions. As the spout is extended, causing the invertible fold portion to invert, each ear rotates inwardly about its point of attachment until the ears extend inwardly perpendicular to the longitudinal axis of the spout. In this orientation, the ears and nibs define a central flow aperture having a dentated perimeter for the outflow of liquid and a plurality of peripheral vent openings, one between each ear, for the inflow of air.

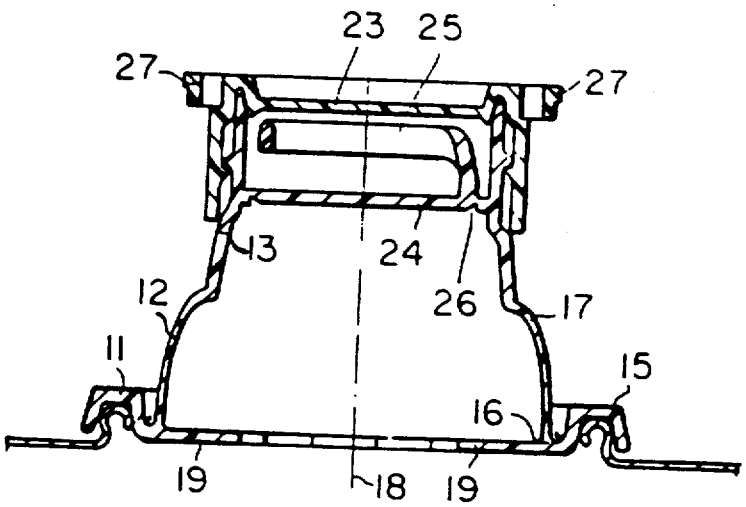

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, lines 14 through 32:

Body portion 12 is a generally funnel shaped member which is secured at its larger circumferential edge to mounting portion 11 and at its smaller circumferential edge to neck portion [12] *13*. Body portion 12 includes [invertible fold portions]0 *first and second invertible folds which are spatially located relative to each other in the nested condition as upper and lower invertible folds* 16 and 17[, which]. *These* folds cause body portion 12 to be generally S-shaped in section along a plane parallel to the longitudinal axis 18 of nestable pouring spout 10. Body portion 12 is substantially circular in cross-section along a plane perpendicular to axis 18. *In the nested orientation of FIG. 1, the second or lower invertible fold 17, which is positioned between body portion 12 and neck portion 13, is below first or upper invertible fold 16 which is positioned between body portion 12 and annular mounting portion 11. In the extended orientation of FIG. 2, invertible fold portion 17 is extended to a position above invertible fold portion 16, both portions undergoing an inversion in order to make the transition from nested to extended orientations.* Attached at the outside surface of invertible fold portion 16 is a plurality of circumferentially spaced ears 19, each of which extends downwardly substantially parallel to longitudinal axis 18 when nestable pouring spout 10 is in its nested orientation. In this orientation, the ears do not restrict the opening of the container and do not interfere with the attainment of a fully nested orientation by the neck and body portions. Ears 19 provide a self-venting action for spout 10, which will be described in greater detail below.

AS A RESULT OF REEXAMINATION, IT HAS BEEN DETERMINED THAT:

Claims 5 and 14 are cancelled.

claims 1, 3, 6, 12 and 15 are determined to be patentable as amended.

Claims 2, 4, 7–11, 13, 16 and 17, dependent on an amended claim, are determined to be patentable.

1. A pouring spout for use with a container, comprising:

a spout having [means] *first and second invertible folds* for alternately disposing said spout in a nested orientation or in an extended pouring orientation;

means for securing said pouring spout to said container; and a plurality of ears [moveably] attached *to said first invertible fold which is the upper invertible fold of the two when said spout is in said nested orientation and movable* with respect to said spout, said ears extending inwardly within said spout and cooperating to define a central flow aperture for the outflow of liquid and a plurality of peripheral vent openings for the inflow of air, when, and only when, said spout is disposed in the extended pouring orientation.

3. A spout for use with a container having an opening herein, said spout being configured to be alternately disposed in nested and extended orientations, comprising:

an annular mounting portion;

means for securing said annular mounting portion to said container at the opening;

a neck portion located concentrically with and inwardly of said mounting portion;

a body portion disposed between said neck portion and said annular mounting portion and of integral construction therewith;

[means] *first and second invertible folds* for extending said spout from the nested orientation to the extended orientation, *said first invertible fold positioned between said annular mounting portion and said body portion and said second invertible fold positioned between said body portion and said neck portion;* [and]

a plurality of circumferentially spaced ears attached to said [spout] *first invertible fold* such that said ears extend downwardly without interference with said neck portion *and without extending below said second invertible fold* when said spout is in its nested orientation, said ears extending inwardly substantially perpendicular to the longitudinal axis of said neck portion when said spout is in its extended orientation; *and* said plurality of ears cooperating to define a central flow aperture for the outflow of liquid, the central flow aperture having a dentated perimeter, each pair of adjacent ears defining a peripheral vent opening therebetween for the inflow of air, when said spout is in its extended orientation.

6. [The spout of claim 5, wherein] *A spout for use with a container having an opening herein, said spout being configured to be alternately disposed in nested and extended orientations, comprising:*

*an annular mounting portion;*

*mans for securing said annular mounting portion to said container at the opening;*

*a neck portion located concentrically with and inwardly of said mounting portion;*

*a body portion disposed between said neck portion and said annular mounting portion and of integral construction therewith, said body portion having an invertible fold portion adjacent said mounting portion;*

*means for extending said spout from the nested orientation to the extended orientation;*

*a plurality of circumferentially spaced ears attached directly to the outer surface of said invertible fold portion such that said ears extend downwardly without interference with said neck portion when said spout is in its nested orientation, said ears extending inwardly substantially perpendicular to the longitudinal axis of said neck portion when said spout is in its extended orientation;*

*said plurality of ears cooperating to define a central flow aperture for the outflow of liquid, the central flow aperture having a dentated perimeter, each pair of*

*adjacent ears defining a peripheral vent opening therebetween for the inflow of air, when said spout is in its extended orientation; and* said ears are substantially rectangular plates, each having a width and a length dimension such that the end portions of adjacent ears are contiguous when said spout is in its extended orientation, whereby a substantially triangular vent opening is provided between adjacent ears.

12. An improved container spout of the type having an outer mounting portion, a smaller inner tubular neck portion, and a body portion secured to said mounting portion which extends downwardly and inwardly therefrom and is secured to said neck portion, said body portion having an invertible fold portion adjacent said mounting portion, which spout is extendable from a nested orientation to a pouring orientation and vice versa, and is secured to an opening in the container, wherein the improvement comprises:

a pluarality of circumferentially spaced ears attached to said [spout] *invertible fold portion* such that said ears extend downwardly to avoid interference with said neck portion *and without extending below said body portion* when said spout is in its nested orientation, said ears extending inwardly substantially perpendicular to the longitudinal axis of said neck portion when said spout is in its extended orientation; *and* said plurality of ears cooperating to define a central flow aperture for the outflow of liquid, the central flow aperture having adentated perimeter, each pair of adjacent ears defining a peripheral vent opening therebetween for the inflow of air, when said spout is in its extended orientation.

15. [The spout of claim 14, wherein] *An improved container spout of the type having an outer mounting portion, a smaller inner tubular neck portion, and a body portion secured to said mounting portion which extends downwardly and inwardly therefrom and is secured to said neck portion, said body portion having an invertible fold portion adjacent said mounting portion, which spout is extendable from a nested orientation to a pouring orientation and vice versa, and is secured to an opening in the container, wherein the improvement comprises:*

*a plurality of circumferentially spaced ears attached directly to the outer surface of the invertible fold portion of said body portion such that said ears rotate inwardly substantially about their point of attachment as the invertible fold inverts when said spout is drawn into its extended orientation, said ears extend downwardly to avoid interference with said neck portion when said spout is in its nested orientation and said ears extending inwardly substantially perpendicular to the longitudinal axis of said neck portion when said spout is in its extended orientation;*

*said plurality of ears cooperating to define a central flow aperture for the outflow of liquid, the central flow aperture having a dentated perimeter, each pair of adjacent ears defining a peripheral vent opening therebetween for the inflow of air, when said spout is in its extended orientation, the area of said central flow aperture and the area of said peripheral vent openings are such that the neck portion does not flow full, thereby maintaining an air passageway through the neck portion into the container at all pouring angles; and* said ears are substantially rectangular plates, each having a width and a length dimension such that the end portions of adjacent ears are contiguous when said spout is in its extended orientation, whereby a substantially triangular vent opening is provided between adjacent ears.

* * * * *